US006056170A

United States Patent [19]

Lizarbe

[11] Patent Number: 6,056,170

[45] Date of Patent: May 2, 2000

[54] FORM FOR FOLDING SHIRTS

[76] Inventor: Antonio Lizarbe, 57, rue de Genéve, 93120 La Courneuve, France

[21] Appl. No.: 09/297,268

[22] PCT Filed: Oct. 23, 1997

[86] PCT No.: PCT/FR97/01899

§ 371 Date: Jul. 8, 1999

§ 102(e) Date: Jul. 8, 1999

[87] PCT Pub. No.: WO98/18994

PCT Pub. Date: May 7, 1998

[30] Foreign Application Priority Data

Oct. 28, 1996 [FR] France ..... 96 13084

[51] Int. Cl.[7] ..... A41M 33/00

[52] U.S. Cl. ..... 223/37; 223/38

[58] Field of Search ..... 223/37, 38, 1, 223/87; 99/422

[56] References Cited

U.S. PATENT DOCUMENTS

| | | | |
|---|---|---|---|
| 1,251,461 | 1/1918 | Bachmann | 223/87 |
| 1,375,808 | 4/1921 | Witbeck | 223/87 |
| 2,998,251 | 6/1961 | Ziegler | 223/37 |
| 4,944,417 | 7/1990 | Datlow | 223/87 |
| 5,921,173 | 7/1999 | Grycan et al. | 99/422 |
| 5,947,349 | 9/1999 | Shaalan | 223/87 |

*Primary Examiner*—Bibhu Mohanty
*Attorney, Agent, or Firm*—George T. Marcou; Kilpatrick Stockton LLP

[57] ABSTRACT

The invention concerns a device for facilitating the uniform folding of shirts and T-shirts in household ironing. It is characterised by a main part (1) almost rectangular in shape of fine thickness and with a surface not adhering to cloth materials, comprising on one of its short sides a projection (2) for gripping it.

10 Claims, 3 Drawing Sheets

FORM FOR FOLDING SHIRTS

Figure 1A:
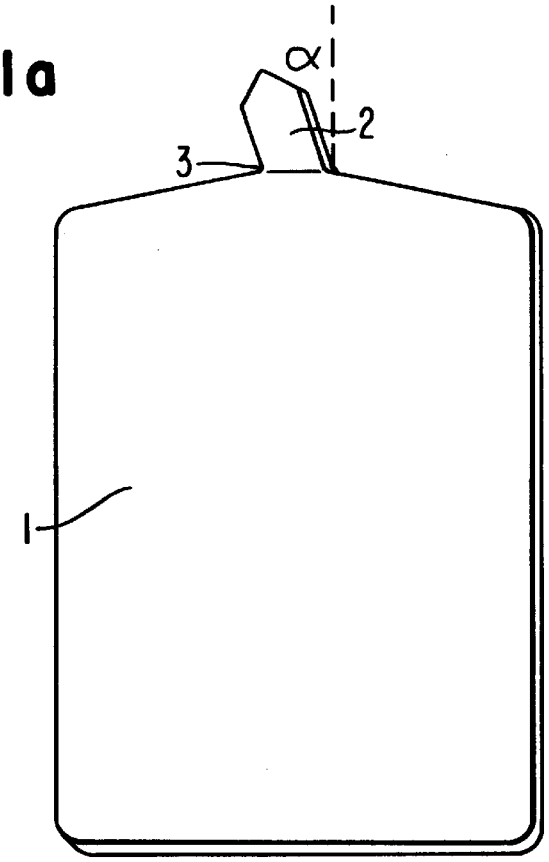

The present invention concerns a device to facilitate the uniform folding of shirts and tee-shirts ironed domestically.

At present there is no device available off the shelf to facilitate the folding of shirts and tee-shirts when ironed domestically, and these garments are therefore folded in a random and personalised manner.

U.S. Pat. No. 2,988,251 concerns a device for folding shirts comprising two plates articulated together, one of which has a cavity and the other a front groove to prevent crushing the collar and to align the buttons with the neck of the shirt when folding. Patent EP 46 2074 concerns a device for folding shirts, enabling them to be transported without damage in suitcases, and including a plate and a frame articulated to the plate and provided with small detents to prevent the shirt moving, the closing of the articulated frame onto the plate therefore gripping the garment previously placed on the latter, may, with a shearing effect, damage the shirts by being cut. The above two inventions do not meet the expectations of consumers, which are simplicity of use, speed and effectiveness.

The invention remedies this want of a simple and effective accessory and the device in accordance with the invention speeds up shaping and enables the shape of folded shirts to be made uniform at a moderate price.

The invention concerns a device for folding shirts and tee-shirts when ironed domestically. The invention consists in a main part, of the solid template type, of quasi-rectangular shape, a few millimeters thick, enabling a shirt to be folded by placing the template on the ironed garment, laid flat on an ironing board, for example, the sides and bottom of the garment being folded one by one over the device. The device is then removed by sliding it out through the top part of the folded garment. The device has a low-friction surface state or surface coating, for example based on silicone, so that it does not adhere to textile materials, and is provided on its top shorter side with a fixed inclined projection forming a handle. The angle $\alpha$ of the projection relative to the plane axis of the template 1 is in the range from 50 to 60° and provides a free space to the rear of the neck of the shirt 5 and facilitates holding it.

The upper part of the template has a shape matching the slope of the shoulders of a shirt when laid flat, the side a-3 and the side b-3 being slightly inclined to the horizontal ab in opposite directions, and the main part is slightly conical in the downward direction; the lower part is a few millimeters narrower than the upper part which facilitates removing the template when the garment has been folded, and all edges are rounded to prevent all risk of snagging on the fabric and also to facilitate extracting the template from the garment. The device can be made from various dense materials selected from materials such as wood, particle board, metal, dense plastics materials, glass or transparent plastics materials.

The non-stick surface is achieved either by polishing in the case of materials such as wood or by a coating with a low coefficient of friction.

The projection 2, holding means, incorporated in the central part, or over all or part, of the top side of the template matching the shoulders a-3-b can include a hole for hanging up the device and can additionally incorporate a substantially horizontal step.

The solid surface of the template provides a support for advertising or other material.

FIG. 1*a* is a plan view of the invention.

Figure 1B:
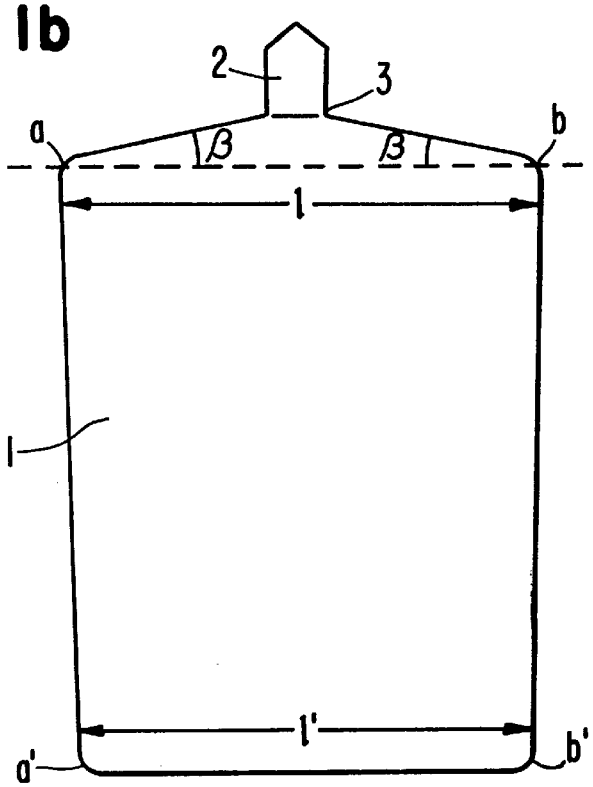

FIG. 1*b* is a front view of one particular embodiment of the template.

Figure 2A:
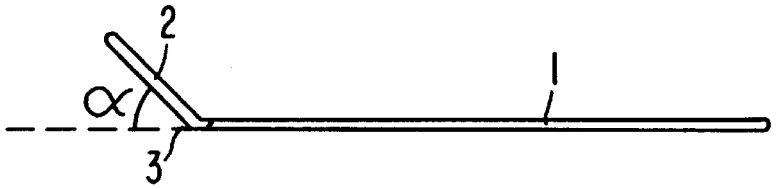

FIG. 2*a* is a side view of the template.

Figure 2B:
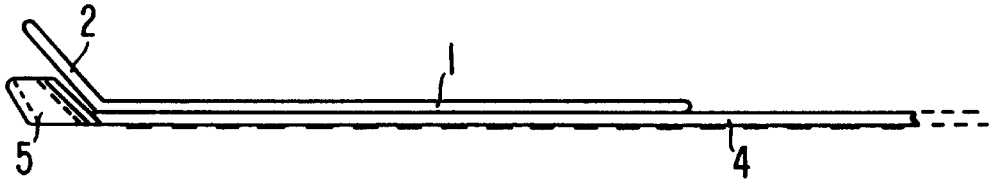

FIG. 2*b* is a side view of the template on top of a shirt to be folded.

Figure 2C:
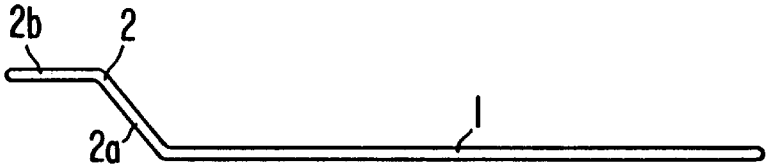

FIG. 2*c* is a side view of a different embodiment.

Figure 3A:
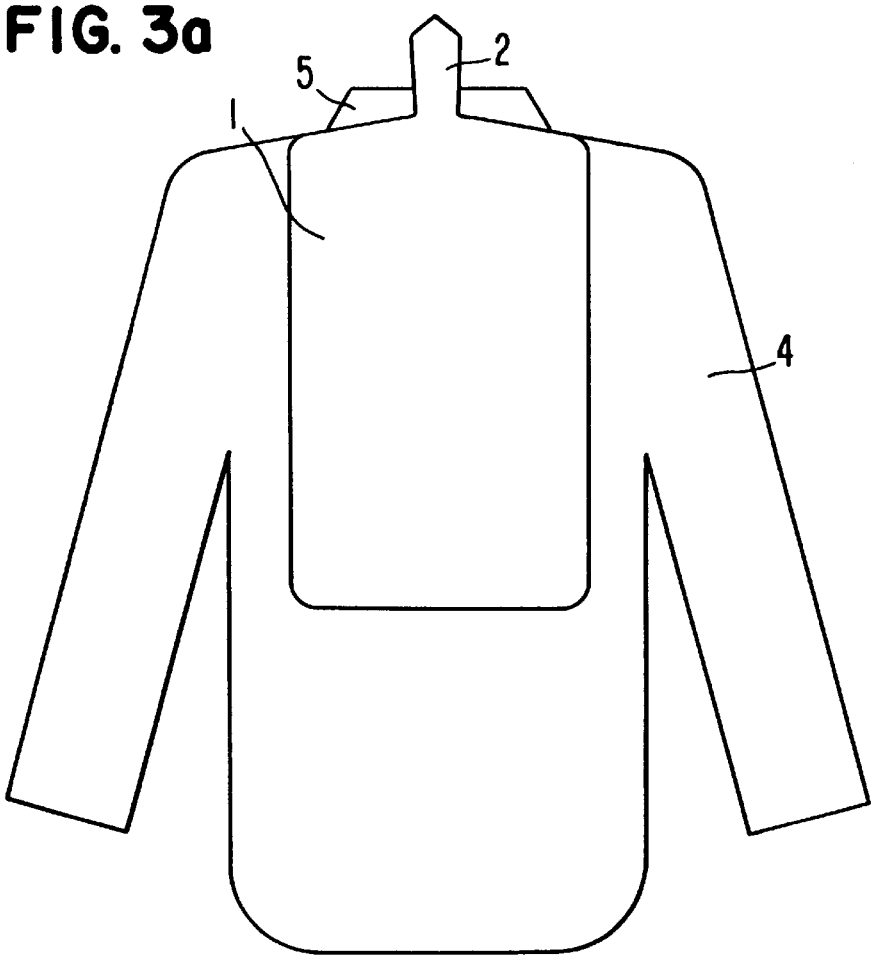

FIG. 3*a* is a front view of the device on the item to be folded.

Figure 3B:
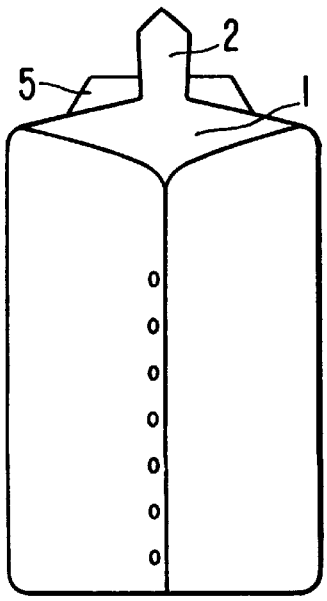

FIG. 3*b* shows the shirt or tee-shirt folded onto the device.

FIG. 1*a* is an overall plan view of the invention.

The main part 1 or thin and quasi-rectangular template is joined to a fixed projection 2 serving as a handle by a joining area 3.

The projection 2 is at an angle $\alpha$ to the plane axis of the template 1.

FIG. 1*b* is a front view of a particular embodiment.

- the main part is formed by the sides aa' bb' a'b' and by the sides formed between a and the joining area 3 and b with the joining area 3.
- the triangle formed between a-3-b has a very small height because the angles $\beta$ between the side a-3 and the horizontal ab and the side b-3 and the horizontal ab are only a few degrees, matching the shoulder part of a shirt laid flat on a table.
- the axis a b is one to four millimeters wider than the axis a' b', so that a slight conicity is produced, facilitating extraction of the device when the garment has been folded.
- the corners a b a' b' are rounded, as are all edges of the device.

FIG. 2*a* shows the thin side or profile.

FIG. 2*b* is a side view of the device in place on a shirt 4, the neck 5 of the shirt 4 being under the projection 2 of the device.

FIG. 2*c* is a side view of the projection 2 consisting of an upward step 2*a* continued by an extension 2*b* that is substantially horizontal and forms a handle.

FIG. 3*a* shows the device in place on the item to be folded, seen from the front of the template 1 and laid on the upper central part of the shirt 4 with the projection 2 on top of the neck 5 of the shirt.

FIG. 3*b* shows the device when the shirt or tee-shirt has been folded over it.

The device in accordance with the invention is used in the following manner:

- the ironed shirt or tee-shirt 4 is laid face down on the ironing board and the device is placed on the upper part of the back of the garment, as shown in FIG. 3*a*, with the projection 2 on top of the neck 5 of the shirt.
- the sides and bottom of the garment are folded over the device one by one, only the projection on the upper part of the template remaining visible, as shown in FIG. 3*b*.
- the device is removed by grasping it by the projection 2 and sliding it out via the upper part of the folded garment.

A plurality of templates can be provided to cater for different sizes of garments.

I claim:

1. A device for folding shirts and tee-shirts when ironed domestically having a thin quasi-rectangular main part of the solid template type enabling a shirt to be folded by placing the template on the ironed garment, when laid flat on an ironing board, for example, the sides and bottom of the garment being folded one by one over the device, and the device then being removed by sliding it out through the upper part of the folded garment, characterised in that it has a surface state or a surface coating such that it does not adhere to textile materials and has on its upper shorter side a fixed projection forming an inclined handle to facilitate holding it and to provide a free space behind the neck of the shirt.

2. A device according to claim 1 characterised in that it is a few millimeters thick.

3. A device according to claim 1 characterised in that, to facilitate holding it, the projection is at an angle $\alpha$ in the range from 5° to 60° to the plane axis of the template.

4. A device according to claim 1 characterised in that the upper part of the template has a slightly triangular shape matching the slope of the shoulders of a shirt, first and second sides being slightly inclined to the horizontal in opposite directions.

5. A device according to claim 1 characterised in that the main part is very slightly conical, its lower part being a few millimeters narrower than its upper part to facilitate removing the template when the garment has been folded.

6. A device according to claim 1 characterised in that all the edges are rounded.

7. A device according to claim 1 characterised in that it has a low-friction coating.

8. A device according to claim 1 characterised in that it is made of a dense material selected from materials such as wood, particle board, metal, dense plastics material, glass or transparent plastics material.

9. A device according to claim 1 characterised in that the handle has a substantially horizontal step.

10. An application of the device according to claim 1 characterised in that the solid part of the template can be used to carry advertising.

* * * * *